US006746279B1

(12) United States Patent
Lopez

(10) Patent No.: US 6,746,279 B1
(45) Date of Patent: Jun. 8, 2004

(54) POWER DISTRIBUTION SYSTEM

(75) Inventor: Alberto A. Lopez, Gilbert, AZ (US)

(73) Assignee: IXOS Limited, Thame Oxon (GB)

( * ) Notice: Subject to any disclaimer, the term of this patent is extended or adjusted under 35 U.S.C. 154(b) by 0 days.

(21) Appl. No.: 09/707,677

(22) Filed: Nov. 7, 2000

(51) Int. Cl.[7] ..... H01R 13/66; H01R 33/945; H01R 11/09

(52) U.S. Cl. ..... 439/620; 439/723

(58) Field of Search ..... 439/723, 620, 439/721, 724, 621, 538, 638, 49, 76.1

(56) References Cited

U.S. PATENT DOCUMENTS

| | | | | | |
|---|---|---|---|---|---|
| 3,573,704 | A | * | 4/1971 | Tarver | 439/76.1 |
| 4,372,638 | A | * | 2/1983 | Sohler | 439/857 |
| 4,687,270 | A | | 8/1987 | Plyler et al. | 439/350 |
| 4,782,245 | A | * | 11/1988 | Henry | 307/112 |
| 5,013,252 | A | | 5/1991 | Nienhuis et al. | 439/215 |
| 5,032,092 | A | | 7/1991 | Linn | 439/723 |
| 5,108,300 | A | * | 4/1992 | Weber | 439/188 |
| 5,203,711 | A | | 4/1993 | Bogiel | 439/215 |
| 5,252,086 | A | | 10/1993 | Russell et al. | 439/215 |
| 5,345,210 | A | | 9/1994 | Swenson et al. | 337/163 |
| 5,362,261 | A | * | 11/1994 | Puerner | 439/752 |
| 5,407,366 | A | * | 4/1995 | Briones et al. | 439/639 |
| 5,514,009 | A | * | 5/1996 | Hughes | 439/35 |
| 5,540,602 | A | * | 7/1996 | Bell | 439/721 |
| 5,599,190 | A | | 2/1997 | Willette | 439/49 |
| 5,655,933 | A | | 8/1997 | Skowronski | 439/654 |
| 5,755,583 | A | | 5/1998 | McCarthy | 439/215 |
| 5,795,193 | A | * | 8/1998 | Yang | 439/621 |
| 5,915,984 | A | | 6/1999 | Rupert et al. | 439/215 |
| 6,352,447 | B1 | * | 3/2002 | Ruth | 439/540.1 |
| 2003/0036316 | A1 | * | 2/2003 | Fujita et al. | 439/701 |

FOREIGN PATENT DOCUMENTS

| | | | |
|---|---|---|---|
| EP | 0 455 398 A2 | 11/1991 | H01H/85/18 |

OTHER PUBLICATIONS

Printed from <http://www.audiocontrol.com/images/Aud-Con_Product/Eql.jpg on Feb. 26, 2001.

*PC 4200/4400/4800/6600 Owner's Manual*. Precision-Power, Inc. Undated.

* cited by examiner

*Primary Examiner*—Chandrika Prasad
(74) *Attorney, Agent, or Firm*—Louis J. Hoffman; Edwin A. Suominen

(57) ABSTRACT

An exemplary system includes a power distribution block and a set of connectors that are configured to be removably coupled to the power distribution block. The exemplary system is useful for distributing power (pneumatic, hydraulic, electrical, etc.). The set of connectors includes connectors of at least two types. The block includes two or more conduction paths that each have two opposite ends. The block and connectors are configured such that one or more connectors of any type in the set can be removably coupled to at least one of the conduction paths, at either end of the paths. Each end of each conduction path connects (both electrically and mechanically) to no more than one connector. Methods and other systems with different advantageous configurations are also described.

11 Claims, 13 Drawing Sheets

POWER DISTRIBUTION SYSTEM

BACKGROUND OF THE INVENTION

Conventional power distribution blocks transmit a flow of power (hydraulic, pneumatic, electrical, etc.) among a predetermined configuration of inputs and outputs. To split RF power from a single source (e.g., a receiving antenna) into two outputs, for example, a "T" connector may act as a distribution point, with one input connector and two output connectors attaching to it. A "Y" fitting may split a flow of compressed air from a single hose into parallel flows in two separate hoses, with airtight connections attaching to the fitting at its inputs and outputs. As another example, high-current electrical power often passes from a single source (e.g., a lead-acid battery) to several destinations using a pair of metal blocks secured together with screws and having wires sandwiched between them.

Many situations call for the distribution of power from one or more sources to one or more destinations to change. For example, a system distributing power to a number of output cables may at some point acquire an additional component or user that requires power flow via a cable dedicated to it. In many conventional systems, providing an additional output cable requires inserting a two-way distribution block in the power flow of one of the existing output cables, such that the existing and new output cables share the original power of that output. In other conventional systems, providing an additional output cable requires replacing an existing distribution block with a larger distribution block. Reconfiguration of these conventional types of power distribution systems requires an replacement or augmentation of existing power distribution blocks.

Requiring the use of additional power distribution blocks makes it difficult to reconfigure a power distribution system. The individual users of consumer electronics (e.g., car audio enthusiasts) who often implement such systems typically prefer not to purchase additional hardware whenever they wish to reconfigure their equipment installations. Planning such installations ahead of time to avoid reconfiguration can require the user to make a bewildering number of choices in advance. Consequently, such users still need, and lack, a power distribution system that they can easily reconfigure with less reliance on additional distribution blocks.

A need also remains for an electrical fuse assembly rated at high current that does not require bulky high-current fuses. It is known to create a high-current electrical fuse assembly from smaller fuses arrayed in parallel, for example as discussed in U.S. Pat. No. 5,345,210 to Swensen et al. However, conventional parallel-fuse assemblies have comparable width (with respect to the overall direction of current flow through the assembly) to that of a single high-current fuse. Consequently, a desirable but presently unavailable high-current fuse assembly would employ a parallel-array of smaller fuses in a physically compact configuration.

SUMMARY OF THE INVENTION

A system for the distribution of power (pneumatic, hydraulic, electrical, etc.) according to various aspects of the present invention includes a power distribution block and a set of connectors that are configured to be removably coupled to the power distribution block. The set of connectors includes connectors of at least two types. The block includes two or more conduction paths that each have two opposite ends. The block and connectors are configured such that one or more connectors of any type in the set can be removably coupled to at least one of the conduction paths, at either end of the paths. Each end of each conduction path connects (both electrically and mechanically) to no more than one connector.

Advantageously, the conduction paths can be disposed substantially parallel to each other. Such a configuration permits parallel power flows to continue along a substantially straight path in and out of opposite connectors.

By providing a power distribution block with multiple conduction paths and connectors of different types that can all couple to the conduction paths in different combinations, a power distribution system according to various aspects of the invention reconfigures easily. According to a particularly advantageous aspect, the conduction paths can be isolated from each other (with a separate connector on each end of each path) or coupled together by a larger connector that couples to multiple adjacent conduction paths.

In a power distribution system according to another advantageous aspect of the invention, connectors of a first type have two or more mating interfaces while connectors of a second type have just one mating interface. In such a system, a connector of the first type can couple power from a single source to multiple conduction paths in the system's distribution block. Separate connectors of the second type can then distribute the power from the conduction paths to multiple outputs.

Advantageously, the number of conduction paths used for power distribution in such a system can be configured simply by selecting a connector of the first type with the desired number of mating interfaces. As an example, a power distribution system according to this aspect of the invention can have a power distribution block with four conduction paths. Power can be coupled from a single source to four outputs using a connector of the first type (having four mating interfaces) and four connectors of the second type (each having a single mating interface). Alternatively, power can be coupled from two sources to two pairs of outputs using connectors of the first type. (with two mating interfaces each) and four single-interface connectors of the second type.

In a system according to another advantageous aspect of the invention, connectors of the first and second types each include one or more mating interfaces that are couplable (i.e., capable of being coupled, perhaps already coupled) to cable having circular and non-circular cross sections, respectively. By providing different types of connectors capable of receiving different types of cable, such a system makes interconnection of cables easier, with less difficulty posed by differing cable types.

In a method for configuring the transmission of power between a plurality of connectors, according to various aspects of the invention, a power distribution block is provided along with a set of removable connectors. The set of connectors includes connectors of a first type and a second type and, if desired, connectors of additional types. Two or more connectors are selected from the set and coupled to one or more of the conduction paths at the ends of the paths. In the method, the connectors couple to the conduction paths such that at least one of the conduction paths has a different type of connector at each of its ends.

By selecting connectors from a set that includes multiple types of connectors and coupling the selected connectors to one or more conduction paths of a power distribution block, a person or machine carrying out such a method can quickly and easily reconfigure the transmission of power. Advantageously, the set of connectors can include more connectors than can be simultaneously coupled to the conduction paths. When such a large set of connectors is provided, power transmission can be reconfigured in many different ways without the need for additional hardware.

An apparatus for interconnecting parallel fuses according to various aspects of the invention includes at least one column of fuse receptacles that each include first and second terminals. A first electrical conductor couples the first terminals of the receptacles together, while a second electrical conductor couples the second terminals of the receptacles together. Advantageously, the first and second electrical conductors lead from opposite ends of the first column of fuse receptacles and have substantially parallel orientations. Such a configuration can be made more compact than conventional paralleling of fuses because the parallel fuses can be stacked in a column, with each fuse oriented perpendicular to the overall direction of current flow through the apparatus. The column of fuses can be oriented substantially in line with the electrical transmission paths leading to and from the column, maintaining a relatively narrow width of the column regardless of the number of fuses in it. In addition, keeping the column in line with its associated transmission paths permits multiple columns of parallel-connected fuses to be arranged in a compact, convenient fuse matrix.

An apparatus for fusing multiple electrical conduction paths according to various aspects of the invention includes a matrix of fuse receptacles (each having electrical terminals) and several electrical conductors. The matrix includes multiple columns and rows. In each column, electrical conductors couple respective terminals of the receptacles together. Thus, the respective terminals of fuse receptacles in each column electrically connect in parallel.

According to a further aspect of the invention, the apparatus can include two arrays of mating interfaces, which are distinct from the mating interfaces in removable connectors. The arrayed mating interfaces are disposed at opposite ends of the matrix. Each mating interface in one of the arrays couples (through an electrical conductor) to one set of the terminals (connected in parallel) of fuses in one of the columns. Each mating interface in the other array couples to the opposite set of parallel-connected fuse terminals.

Advantageously, the respective mating interfaces of the opposite arrays connect together through respective columns of parallel-connected fuses. Thus, the overall current-carrying capacity of multiple electrical connections can increase without the need for large, bulky fuses. This arrangement is particularly advantageous when the fuse receptacles are configured to receive automotive fuses, which are compact, clearly labeled, and readily available. When the fuse receptacles are all oriented substantially parallel to each other, the fuse matrix is arranged in a way that is aesthetically pleasing, uses space efficiently, and permits quick inspection of fuse labels.

An electrical connector according to another aspect of the invention includes a first portion fabricated from conductive material and a second portion molded from nonconductive material. The first portion includes a substantially circular first aperture, while the second portion includes a substantially rectangular second aperture. The area of the second aperture is larger than the area of the first aperture, and the first and second apertures are substantially coaxial. This configuration provides the connector a suitably tight fit and finish with cable having a rectangular profile while also providing an electrical connection to the cable's square-profile conductive portion without the expense and difficulty of forming a square aperture in a block of conductive material.

The above summary is not an exhaustive list of all aspects of the present invention. Indeed, the inventor contemplates that his invention includes all systems and methods that can be practiced from all suitable combinations of the various aspects summarized above, as well as those disclosed in the detailed description below and particularly pointed out in the claims filed with the application. Such combinations have particular advantages not specifically recited in the above summary.

BRIEF DESCRIPTION OF THE DRAWINGS

Various embodiments of the present invention are described below with reference to the drawings, wherein like designations denote like elements.

DESCRIPTION OF PREFERRED EXEMPLARY EMBODIMENTS

Figure 1:
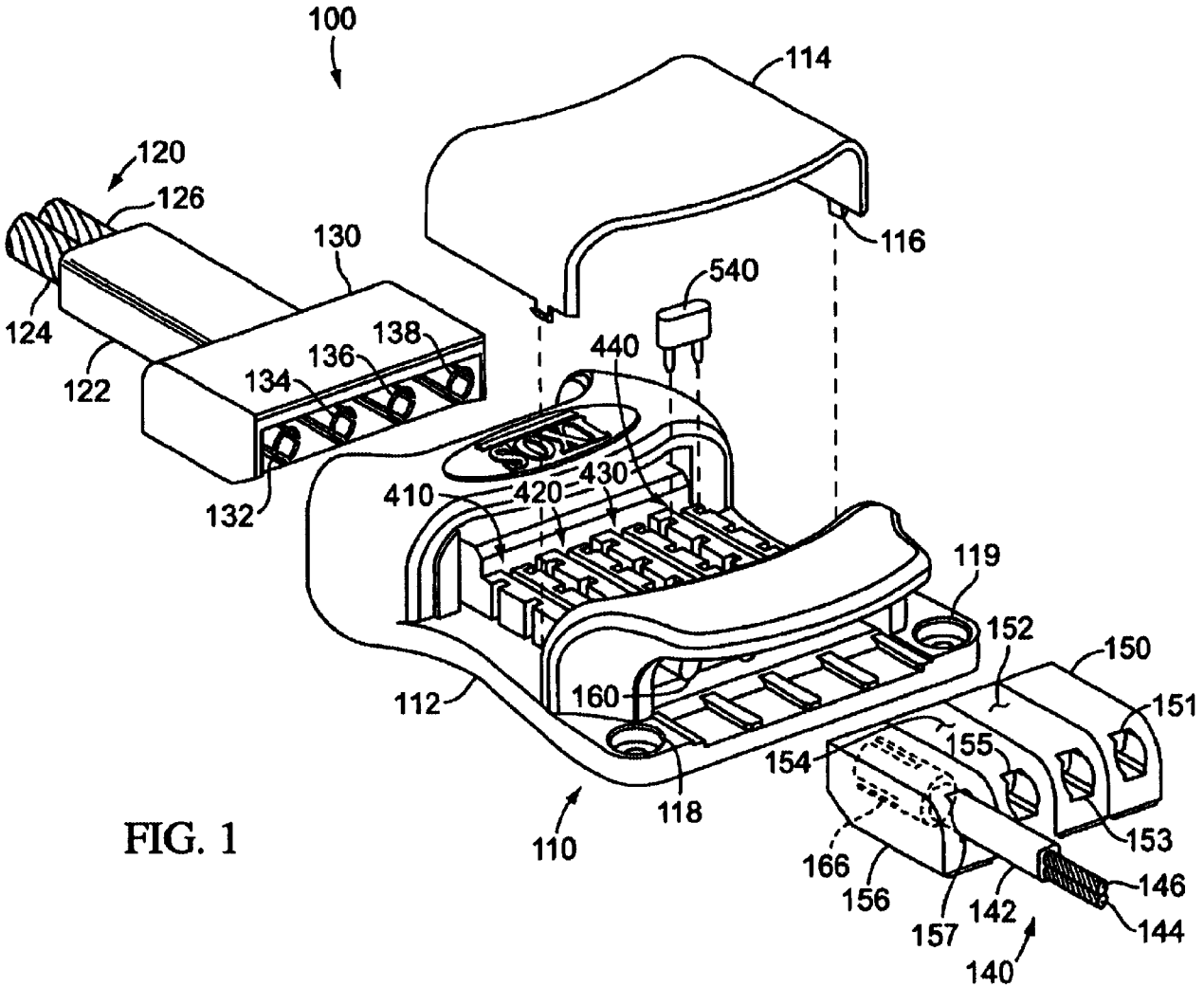
FIG. 1 is a partially exploded perspective view of a power distribution system according to various aspects of the invention.

A power distribution system according to various aspects of the present invention provides a number of benefits including convenient reconfiguration of inputs and outputs and compact, convenient arrangement of fuses. For example, FIGS. 1–6 show various views of a power distribution-system 100 according to various aspects of the present invention. System 100 of FIGS. 1–6 includes a distribution block 110 having four conduction paths 410, 420, 430, and 440, which are protected by parallel fuses in a convenient matrix arrangement. Conduction paths 410–440 (more clearly depicted in FIG. 4) can be configured to connect a single connector 130 on one side of block 110 to one, two, or more connectors on opposite sides of block 110, depending on the type of connectors used. For example, FIG. 4 shows single connector 130 on an opposite side of block 110 from three connectors 150, 152, and 154. As discussed in greater detail below with reference to FIGS. 7–12 and TABLE II below, the use of a standard distribution block with connectors of multiple types permits a power distribution system according to various aspects of the invention to be easily configured in a number of different ways.

In addition to block 110, components of exemplary system 100 include: a removable cover 114 releasably coupled to block 110 by tabs 115 and 116; a single-input, four-output connector 130 that can be removably coupled (in parallel) to all conduction paths 410–440 of block 110; four one-way connectors 150, 152, 154, and 156 that can each be removably coupled (separately) to conduction paths 410–440; and cables 120 and 140, which are coupled to connectors 130 and 156, respectively. Cables that can suitably couple to connectors 150, 152, and 154 are not shown in FIG. 1. Also, all cables are omitted from views of FIGS. 2–6 for ease of illustration although such cables are understood to be present in operation.

Figure 2:
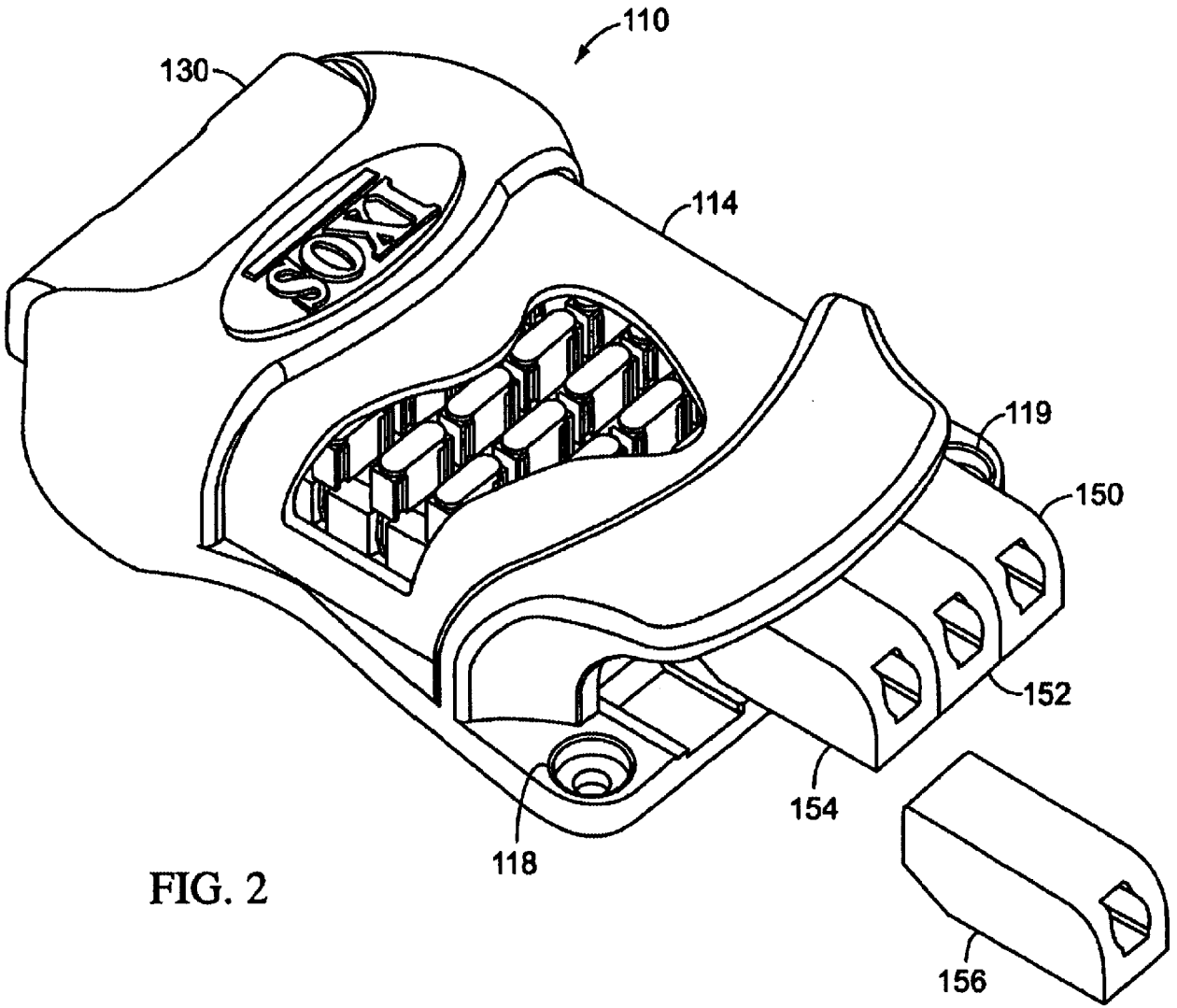
FIG. 2 is a cutaway perspective view of a power distribution block and removable connectors of the system of FIG. 1.

A power distribution block in a power distribution system according to various aspects of the invention includes any structure suitable to transmit a flow of power among a given configuration of inputs and outputs. The type of power (e.g., hydraulic, pneumatic, electrical, etc.) and configuration of inputs and outputs (e.g., one-to-one, one-to-many, many-to-one, etc.) depend on the particular implementation of such a system. For example, block 110 (as depicted in FIGS. 1, 2. 4–6) is configured for transmission of electrical power from the single input connector 130 (through its four outputs with their four mating interfaces) to four output connectors 150, 152, 154, and 156 (with one mating interface each).

Conduction paths in a distribution block of the invention can be configured to transmit power using any mode of transmission suitable for the type of power transmitted. As may be better understood with reference to FIGS. 3 and 4, for example, conduction paths 410–440 in exemplary block 110 transmit electrical power through respective columns of parallel fuses, of which only one, fuse 540, is depicted in FIG. 1. (The H advantageous arrangement or the fuses in block 110 is discussed in greater detail below.)

Conduction path 410 (which is identical to paths 420, 430, and 440) includes a first bus bar 342, a second bus bar 352, and four strips 362, 364, 366, and 368, which are made of resilient material (e.g., spring steel) that is conductive or plated. (To ensure that conductivity is maintained, all electrical contact surfaces described herein are preferably plated with suitably conductive material such as gold, silver, or nickel, with all contacting materials being chemically compatible with each other.) Conduction path 410 further includes a mating interface 332 that connects electrically and mechanically to bus bar 342 through a conductive block 340, and a mating interface 372 that likewise connects to bus bar 352 through another conductive block. Bus bar 342 has indentations on one of its sides, which face away from bus bar 352. Bus bar 352 has indentations on an opposite side, facing away from bus bar 342.

Bus bar 342 and 352 are fabricated from rigid conductive material such as aircraft aluminum, forged brass, or other material, preferably plated as mentioned above for longevity. Bus bars 342 and 352 slide into block 110, cooperating to form a column of fuse receptacles. As illustrated in FIG. 4, terminals of the automotive-type fuses (FIGS. 5 and 6) that are employed in system 100 fit into holes formed by the indentations in bus bars 342 and 352. Strips 362 and 364 improve the electrical contact between bus bar. 342 and the terminals that fit into its indentations on one side of the column of fuses. Similarly, strips 366 and 368 improve electrical contact between bus bar 354 and terminals on the opposite side of the column of fuses that fit into its indentations. A side view of strip 362 is visible in FIG. 6.

A removable cover according to various aspects of the invention includes any structural shell that can be removably placed over conduction paths of a power distribution block. A removable cover can protect circuitry, fuses, or tubing of such conduction paths from exposure while permitting access when desired for maintenance, reconfiguration, etc. Advantageously, a removable cover can be fabricated from transparent or translucent material to allow visual inspection of the conduction paths, for example to detect blown fuses or obstructed tubing. Exemplary cover 114 of block 110 is a shell fabricated from translucent plastic including a generally planar top, generally planar sides, and snap-fit tabs 115 and 116, which extend below the sides to releasably connect cover 114 to block 110.

In a variation, the block includes a cover that selectably provides access to the conduction paths without needing to be removed. One example of such a cover includes an aperture with a sliding window. Another example of such a cover includes hinges on one side that allow it to open (like a door) for access to the conduction paths beneath.

Block 110 further includes an insulating base 112 with mounting holes 118 and 119 for receiving mounting screws. (In variations of a power distribution system of the invention where the benefits of mounting screws, fuses, and a cover are not required, those components can be omitted.) Base 112 can be made of any material suitable for isolating conduction paths 410–440 from each other and the structure on which base 112 may be mounted.

Base 112 can mount on any structure of suitable thickness and structural integrity to withstand structural forces that it may encounter in a particular installation of power distribution system 100. Base 112 can attach to mounting structure in any suitable fashion using mounting hardware, adhesive, welding, etc. For example, conventional bolts or screws can be passed through mounting holes 118 and 119 and into holes in a mounting plate. Such bolts can also anchor nearby removable connectors in place, for example with semi-rigid restraining dips.

A power distribution block according to various aspects of the invention can be fabricated, shaped, and dimensioned in any way considered appealing or necessary, given the constraints of a particular implementation. Suitable manufacturing materials for particular implementations include polymers, fiberglass, and composite materials. For electrical power distribution, such materials should have good insulating properties.

Figure 22:
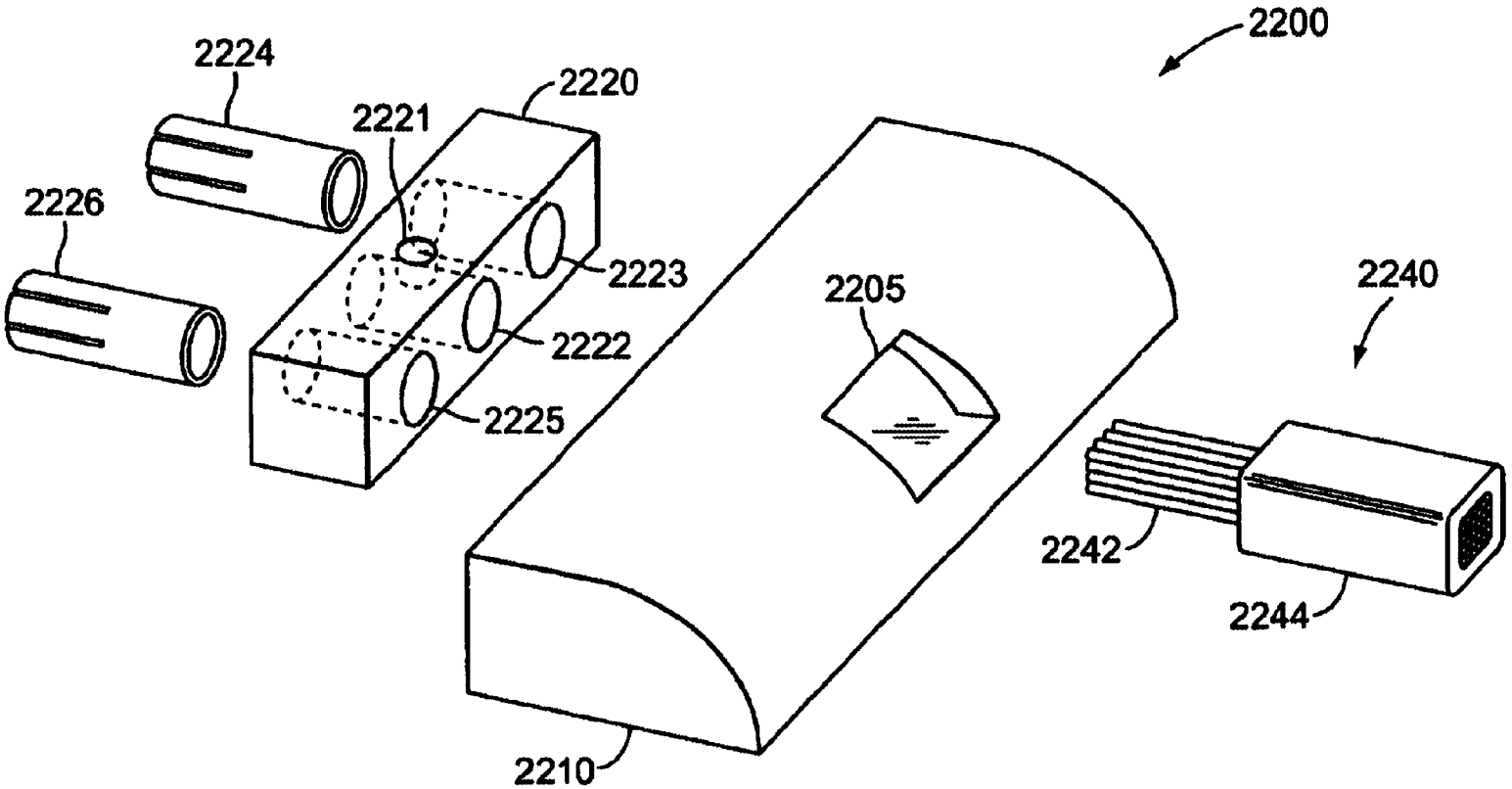
FIG. 22 is an exploded perspective view of the connector according to various aspects of the invention.

A removable connector in a power distribution system according to various aspects of the invention includes any suitable structure that can removably couple to one or more conduction paths of a distribution block to transmit power to or from the conduction paths. Such a connector includes one or more mating interfaces that are couplable in parallel, preferably through a common junction block, to a desired type of cable to convey power between the cable and the conduction path or paths. Connector 130 of exemplary system 100 includes four mating interfaces 132, 134, 136, and 138 (visible in FIG. 1 but not in FIG. 3). These couple power between cable 120 and respective mating interfaces 332, 334, 336, and 338 (visible in FIG. 3 but not in FIG. 1). Connector 156 includes just one mating interface (not visible in FIG. 1), which couples power between cable 140 and mating interface 160 of block 110. Connector 2200, which is discussed below with reference to FIG. 22, is an example of a connector having two mating interfaces.

Connectors 130 and 150–154 of exemplary system 100 each include a housing (i.e., shroud) made of any suitable material (e.g., molded rubber or plastic) with an open side for exposing the mating interface or interfaces of the connector and an aperture on the opposite side to receive cable and allow it to connect to the mating interface(s). The connector housings are preferably constructed (e.g., having sufficient surface area, textured surface, etc.) such that an average user of system 100 can easily insert and remove the connectors from block 110.

A mating interface according to various aspects of the invention includes any structure suitable for removably coupling a conduction path to a cable to transmit power from one to the other. In a power distribution system according to various aspects of the invention, each mating interface of a distribution block can either connect to one mating interface of a connector or can be left uncoupled. Each of the block's mating interfaces can connect directly to just one connector's mating interface. Mating interfaces 132–138, 332–338, and 160 of exemplary system 100 all include electrically conductive contacts for providing such coupling. Any suitable type of contacts and conductive material can be employed. In system 100, mating interfaces of removable connectors (e.g., mating interfaces 132–138) have cylindrical contacts with four opposing slits. Arrayed mating interfaces of block 110 (e.g., mating interface 160), which couple to mating interfaces of the connectors, have slightly smaller cylindrical contacts that fit snugly inside the slitted cylindrical contacts of the connectors' mating interfaces. An electrical connection occurs between the inner surface of the slitted cylindrical contacts and the outer surfaces of the slightly smaller cylindrical contacts.

The connectors' mating interfaces provide mechanical connections, as well as electrical connections, between the connectors and block 110. Consequently, the mating interfaces are preferably fabricated from materials that have both mechanical strength and good electrical conductivity. These two properties are not always found in the same materials. For example, soft metals tend to provide good electrical contacts, initially, because the contact surfaces more easily conform with each other. However, soft materials tend to lose their shape when exposed to mechanical stress. Materials such as forged brass or aircraft aluminum provide a good balance between electrical conductivity and mechanical integrity.

In some embodiments of a power distribution block according to various aspects of the invention, the characteristic impedance between conduction paths and the mating interfaces coupled to them is important. For example, electrical energy comprised of very high currents or very high frequencies is generally transmitted with greatest efficiency through source and return paths having a relatively low characteristic impedance between them. Judicious selection of spacing between adjacent conduction paths and mating interfaces, and the exposed surface areas of the conduction path and mating interfaces, can ensure that the impedance conforms to a desired value. In addition, a conductive plane can be placed at an appropriate proximity to the conduction paths and mating interfaces, for example as a conductive coating on the underside of a power distribution block housing the conduction paths.

The open wall of connector 130 is visible in FIG. 1, while the open walls of connectors 150–156 are not. The aperture of connector 130 is not visible in FIG. 1. However, cable 120 is shown leading to connector 130, with only a portion 122 of its insulating jacket depicted. Apertures 151, 153, 155, and 157 of connectors 150–156 are visible in FIG. 1. Cable 140 is shown leading to connector 156, with only a portion 142 of its insulating jacket depicted.

The insulating jackets and connector housings can be fabricated from any type of polymer having a suitably high resistance under the voltages expected. In circumstances where both positive and negative voltage potentials are expected to occur in the same connector or where capacitance is an issue, the connector housing is preferably fabricated from PTFE (marketed as TEFLON by E.I. duPont de Nemours & Co.) or material with similar dielectric properties.

Any type of cable suitable for the particular type of power transmitted can be employed. For example, parallel-conductor cables 120 and 140 of FIG. 1 are suitable for transmitting high-current (i.e., low impedance or high power, or both) electrical power with a single visually appealing insulating jacket having a roughly rectangular cross-section. Such cables may be desirable in a number of applications including supplying 12 Volt DC power to high-power automotive audio equipment, in which case the parallel conductors are typically stranded copper wire in an insulating jacket, selected from 8, 4, 2, and 1/0 standard wire gauges.

Cables can have various profiles (i.e., cross-sectional shapes) in addition to the rectangular profile of cables 120 and 140, such as square, elliptical, or, more traditionally, circular. A connector housing according to various aspects of the invention can be molded with an input aperture of various possible shapes to accommodate cable of a particular profile.

A connector according to various aspects of the invention can include (1) a housing having an aperture of one shape and (2) a junction block having an aperture of another shape, for establishing an electrical connection between a cable and one or more mating interfaces. Particular advantages of such a connector may be better understood with reference to FIG. 22. Exemplary connector 2200 includes a housing 2210 having a generally square aperture 2205, a junction block 2220, and two mating interfaces 2224 and 2226. Junction block 2220 includes three generally round apertures 2222, 2223, and 2225 oriented parallel to each other, and a smaller aperture 2221 that is perpendicular to, and intersecting with, aperture 2222. Mating interfaces 2224 and 2226 insert into respective apertures 2223 and 2225 of junction block 2220.

Connector 2200 is suited for receiving cable having a square aperture such as cable 2240, an end portion of which is depicted in FIG. 22. Cable 2240 includes a conductive portion 2242, which includes numerous individual strands of conductive wire, and an insulating jacket 2244.

A square aperture is difficult to create (e.g., by drilling or stamping) in a block of existing material. Advantageously, round aperture 2222 of junction block 2220 is able to receive individual strands of conductive portion 2242 of cable 2240 even though portion 2242 has a generally square cross section. The individual strands of portion 2242 can easily conform to the shape of aperture 2222. Thus the need for a square aperture in conductive material (e.g., created by an expensive machining process) is avoided.

The cross-sectional area of aperture 2205 is larger than the cross-section area of aperture 2222. Because of this, and because aperture 2205 can easily be shaped to conform with the cable profile during molding of housing 2210, aperture 2200 can receive the entire profile of cable 2240, including insulating jacket 2244. Thus, connector 2200 receives cable 2240 through aperture 2205 with a suitably tight fit and finish while providing an electrical connection to its square-profile conductive portion 2242 through aperture 2222, which is substantially coaxial with aperture 2205.

Junction block 2220 is preferably fabricated from a milled or forged piece of conductive material such as brass. Aperture 2221 of block 2220 is threaded and dimensioned to receive a set screw, not shown in FIG. 22. The screw's purpose is to insure a good electrical and mechanical connection between conductive portion 2242 and junction block 2220 and, consequently, connector 2200 as a whole. Multiple screws may be desirable for larger cables. Such additional set screws can be oriented parallel to each other or in any other suitable configuration.

Although the type of power distribution primarily discussed herein is electrical, with reference to particular aspects and advantages of exemplary power distribution system 100, power distribution systems according to various aspects of the invention can distribute many different types of power. TABLE I below lists a few examples of various types of mating interfaces for transmission of different types of power and cables employing those interfaces.

TABLE I

| Type of Cable Leading from Connector | Mating Interface Type | Power Type |
|---|---|---|
| Airtight hose | Pressure seal (e.g., snap fit) | Pneumatic |
| Fluid impermeable hose | Pressure seal (e.g., threaded) | Hydraulic |
| Coaxial cable | Type F, RG, N, BNC, SMA, etc. coaxial connector | Electrical |
| Single electrical wire | Snap fit, screw-down, or crimp connector | Electrical |

A particular advantage of a power distribution system according to various aspects of the invention is convenient reconfiguration of power transmission from one or more inputs to one or more outputs. An example of such reconfiguration may be better understood with reference to FIGS. 7–12, which are schematic diagrams of a power distribution system having a distribution block 700 with three conduction paths.

In TABLE II below and FIGS. 7–12, which it references, the connections at the upper part of each figure are inputs, as indicated by arrows pointing toward block 700. The connections at the lower part of each figure depict outputs, as indicated by arrows pointing away from block 700. Outputs and inputs can be coupled to block 700 in any suitable configuration, and connections indicated as inputs in FIGS. 7–12 can be viewed as outputs, and vice versa, to better understand alternate configurations of the power distribution system using block 700.

TABLE II

| FIG. | Connection #1 Inputs: Outputs | Connection #2 Inputs:Outputs | Connection #3 Inputs:Outputs |
|---|---|---|---|
| 7 | 1:2 | 1:1 | — |
| 8 | 1:3 | — | — |
| 9 | 1:1 | — | — |
| 10 | 1:1 | 2:1 | — |
| 11 | 3:1 | — | — |
| 12 | 1:1 | 1:1 | 1:1 |

Figure 7:
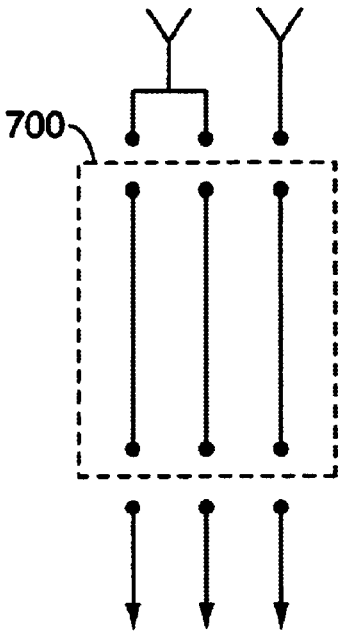
FIGS. 7–12 are schematic diagrams of various possible electrical configurations of the system of FIG. 1.
Figure 8:
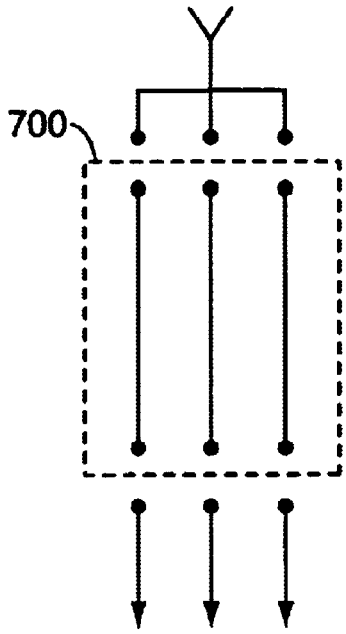
Figure 9:
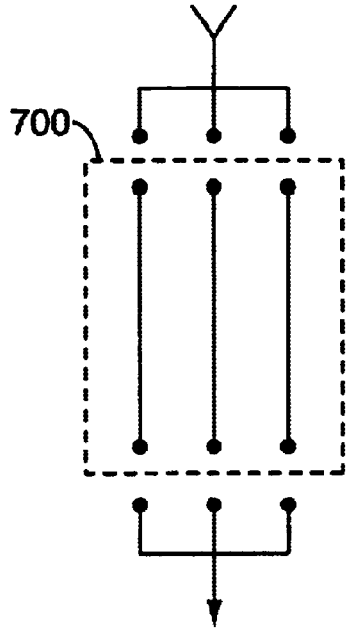
Figure 10:
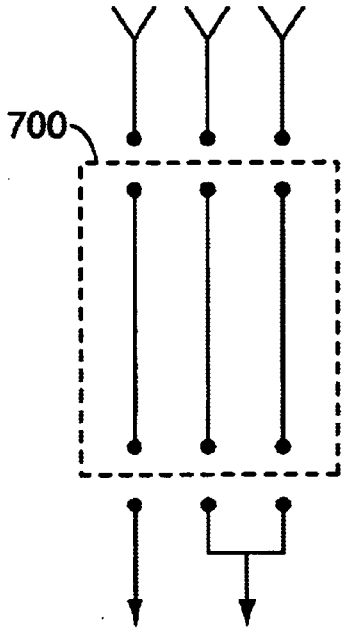
Figure 11:
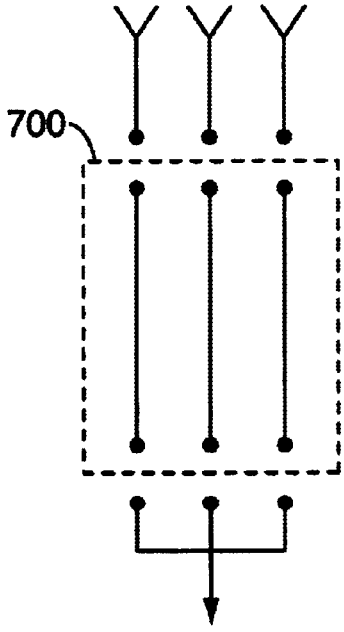
Figure 12:
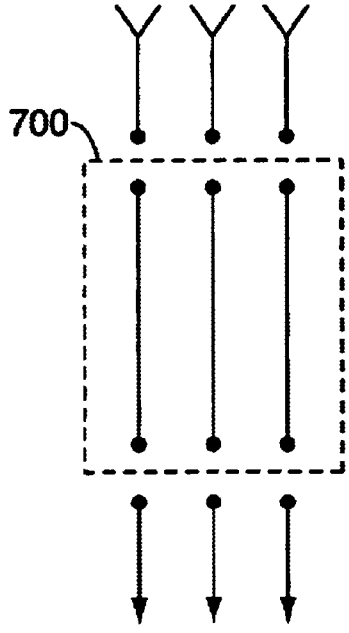

According to a method of the invention, any one of the configurations listed in TABLE II can easily convert, by suitable selection of removable connectors, to any other listed configuration. Changing from the configuration of FIG. 7 to the configuration of FIG. 8 is an illustrative example. In the configuration of FIG. 7, one dual-conductor input couples to two single-conductor outputs and one single-conductor input couples to a single-conductor output. This configuration can convert to the configuration of FIG. 8 simply by exchanging the two input connectors for a single input connector having three conductors.

TABLE III lists various preferred cable configurations of block 700 for the distribution of electrical power at a fused current capacity of 160 A per conduction path, with various numbers of parallel conductions paths per cable, cable types, and cable gauges. Cables connecting to two conduction paths in parallel are rated at 320 A, while cables connecting to four parallel conduction paths are rated at 640 A. For example, a cable connecting to two conduction paths of block 700, each carrying 160 A, is rated at 320 A. Such a cable preferably comprises either (1) a single 1/0 AWG conductor or (2) two 4 AWG conductors in parallel.

TABLE III

| Number of Conduction Paths | Number of Cable Conductors | Conductor Gauge |
|---|---|---|
| 1 | 1 | 4 or 8 |
| 2 | 1 | 1/0 |
| 2 | 2 | 4 |
| 4 | 1 | 3/0 |
| 4 | 2 | 1/0 |
| 4 | 3 | 4 |

According to another advantageous aspect of the invention, parallel fuses such as those in conduction paths 410–440 of exemplary block 110 (FIGS. 1, 4) can be arranged in a column and interconnected in parallel by conductors leading (with substantially parallel orientations) from opposite ends of the column. According to another advantageous aspect, multiple columns of fuses can be arranged in a compact, aesthetically pleasing matrix.

High-current fuses tend to be large and bulky. By using multiple smaller fuses for a given current capacity, the need for high-current fuses can be avoided. This arrangement is particularly advantageous when the fuse receptacles are configured to receive automotive fuses, which are compact, dearly labeled, and readily available. When the fuse receptacles are all oriented substantially parallel to each other, the fuse matrix is arranged in a way that is aesthetically pleasing, uses space efficiently, and permits quick inspection of fuse labels.

Figure 3:
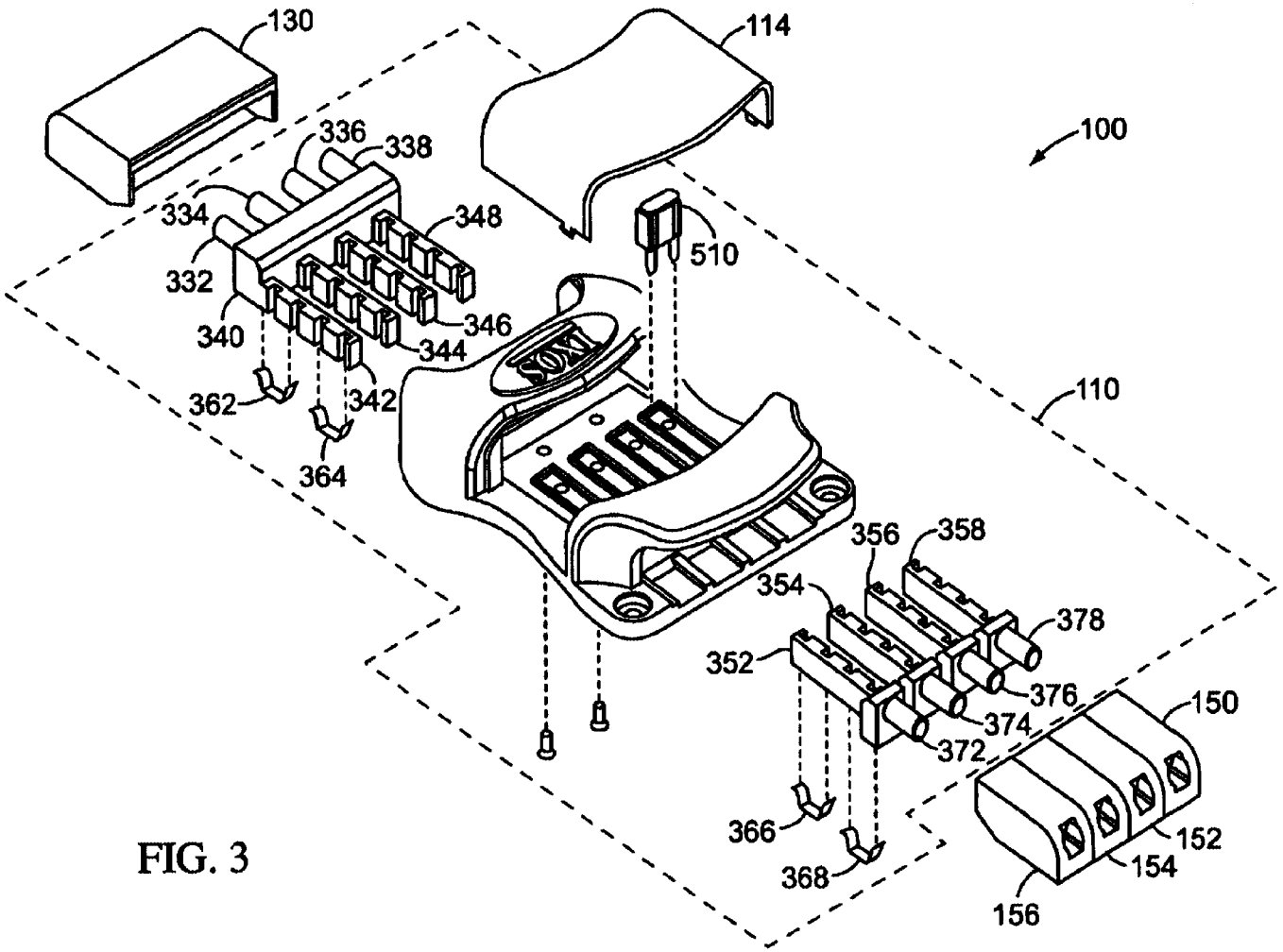
FIG. 3 is a further exploded perspective view of the system of FIG. 1.
Figure 4:
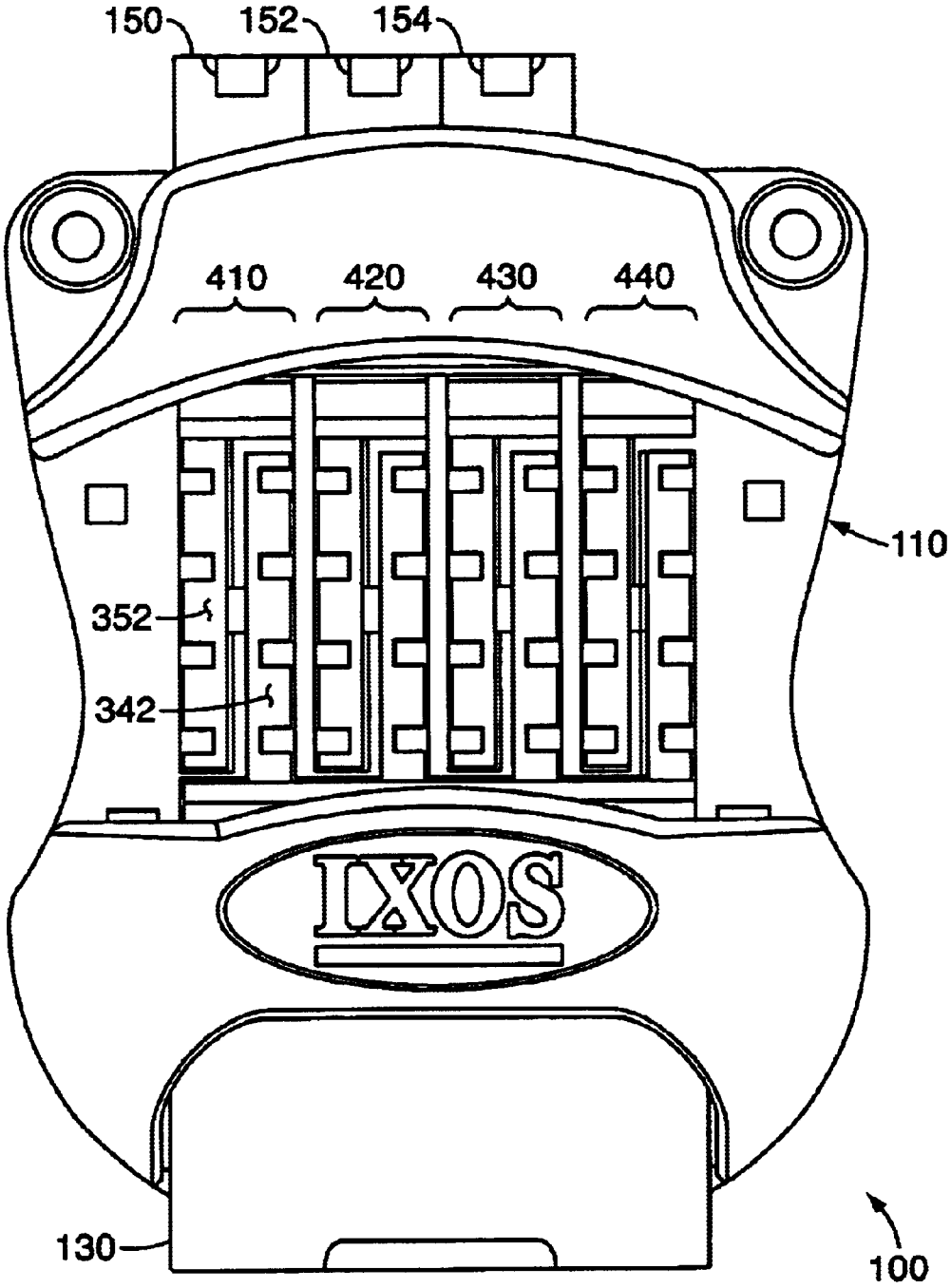
FIG. 4 is a top view of the block and connectors of FIG. 1.
Figure 13:
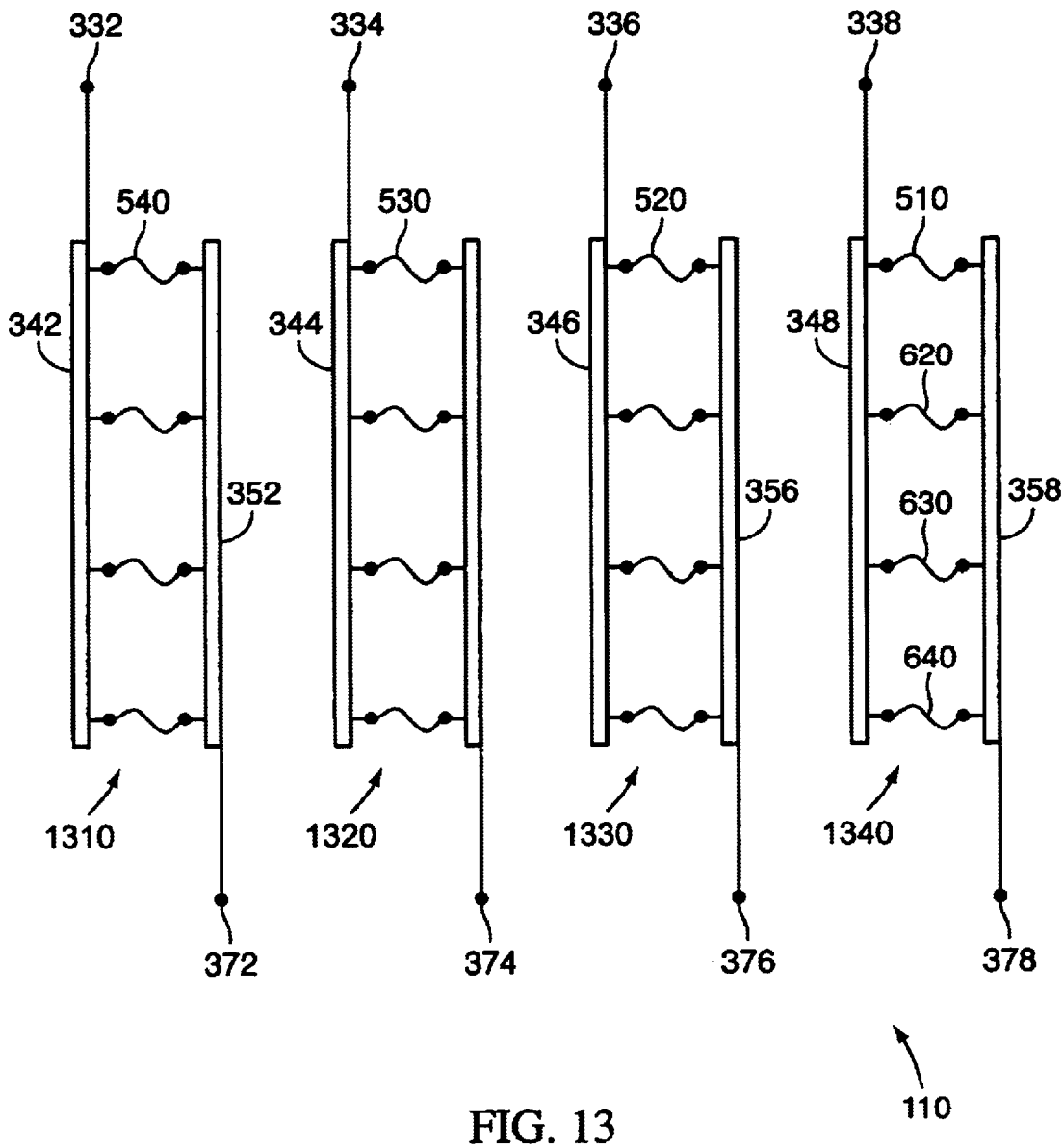
FIG. 13 is a schematic diagram of electrical connections between parallel fuses in separate conduction paths of the system of FIG. 1.

As illustrated in FIGS. 3–4 and 13, block 110 includes first and second pluralities of bus bars that form left and right parts of columns of fuse receptacles. One column is formed from bus bars 342, 352, another from bars 344, 374, another from bars 346, 356, and still another from bus bars 348, 358. Bus bar 342 also serves as a first electrical conductor that couples terminals of the first column of receptacles together, while bar 352 also serves as a second electrical conductor that couples terminals of the first column of receptacles together. Bus bar 344 also serves as a third electrical conductor that couples terminals of the second column of receptacles together, while bar 374 also serves as a fourth electrical conductor that couples terminals of the second column of receptacles together.

Block 110 includes two arrays of mating interfaces. A first one of the arrays (shown at the top of FIG. 13) includes mating interfaces 332, 334, 336, and 338. A second one of the arrays (shown at bottom of FIG. 13) includes mating interfaces 372, 374, 376, and 378. As FIG. 13 illustrates, each mating interface of the first (top) array is coupled to a bus bar (i.e., an electrical conductor) of the first plurality (left sides of columns), which includes the first conductor 342 and the third conductor 344. As further illustrated in FIG. 13, each mating interface of the second (bottom) array is coupled to a bus bar of the second plurality (right sides of columns), which includes the second conductor 352 and the fourth conductor 374.

Figure 5:
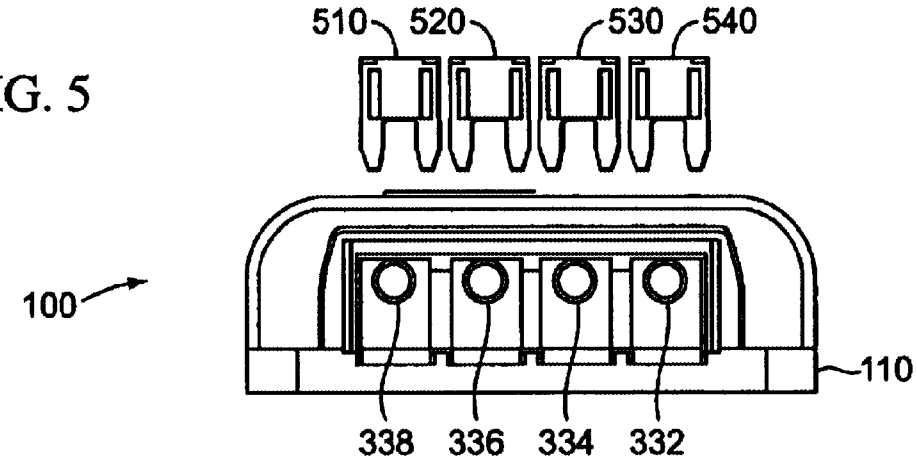
FIG. 5 is an end view of the block of FIG. 1 with a row of fuses shown above the block.
Figure 6:
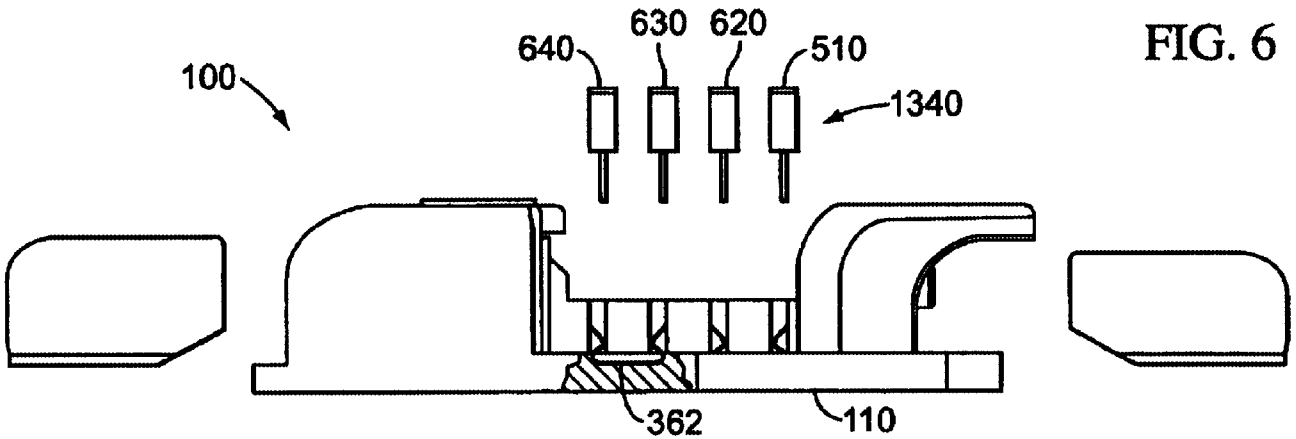
FIG. 6 is a side view of the block of FIG. 1, with fuses and connectors.

An exemplary fuse matrix arrangement (in block 110) may be better understood with reference to FIGS. 2 and 4–6. FIG. 2 illustrates, in a cutaway perspective view, block 110 and rows of fuses with terminals inserted into bus bars 342–348 and 352–358 (not shown in FIG. 2). The bus bars and their indentations for receiving terminals are depicted in the top view of block 110 of FIG. 4. FIG. 5 illustrates a row of fuses to be inserted into block 110, namely fuse 540 (the single fuse depicted in FIGS. 1 and 3) and fuses 510, 520, 530. FIG. 6 illustrates a column 1340 of fuses to be inserted into block 110, namely fuses 510, 620, 630, and 640. Corner fuse 510 is visible in both the row of FIG. 5 and column 1340 of FIG. 6.

The electrical interconnection of fuses in block 100 may be better understood with reference to FIG. 13. Fuses that are also visible in the row and column depicted in FIGS. 5 and 6, respectively, are labeled in FIG. 13, while the other fuses of FIG. 13 are not labeled. Fuse 540 connects in parallel with three other fuses by bus bars 342 and 352 to form column 1310. Similarly, fuses 530, 520, and 510 each connect in parallel with three other fuses to form columns 1320, 1330, and 1340, respectively, by the following combinations of bus bars: 344 and 354 (fuse 530, column 1320); 346 and 356 (fuse 520, column 1330); 348 and 358 (fuse 510, column 1340). Mating interfaces 332, 334, 336, and 338 connect, through respective fuse columns 1310–1340, to respective mating interfaces 372, 374, 376, and 378 (FIGS. 3, 13).

Columns 1310–1340 of exemplary block 110 all have substantially parallel orientations. Bus bars, conductive blocks, and mating interfaces of each conduction path 410–440 cooperate to form a pair of electrical conductors leading from opposite ends of each respective column 1310–1340. The pairs of electrical conductors (like the columns) have substantially parallel orientations, and the overall direction of current flow through block 110 is parallel along conduction paths 410–440.

Advantageously, adjacent conduction paths with parallel-connected fuses, according to various aspects of the invention, can transmit generally parallel flows of electrical current, regardless of the direction of power flow through each individual fuse. In the schematic view of FIG. 13, for example, current can flow from mating interfaces 332–338 to mating interfaces 372–378 in a downward direction, parallel to the orientation of columns 1310–1340. This generally straight current path is preserved even though the current flows through individual fuses of block 110 (e.g., fuses 510, 620, 630, and 640 of column 1340) in a direction perpendicular to the overall current path. Thus, the connection lengths in distribution block 110 can be minimized.

As illustrated in FIG. 3 with reference to exemplary system 100, mating interfaces and respective bus bars of a power distribution block according to various aspects of the invention can connect to each other both electrically and mechanically through common structural blocks. For example, mating interfaces 332–338 are both electrically and mechanically connected to bus bars 342–348, respectively, through electrically conductive blocks (of which only block 340 is labeled in FIG. 3). Mating interfaces 372–378 of individual connectors 150–156 connect electrically and mechanically to bus bars 352–358, respectively, through separate conductive blocks shown but not labeled in FIG. 3. The mating interfaces and bus bars, and the conductor blocks connecting them can all be fabricated from a single unitary piece of conductive material such as forged brass or aircraft aluminum, preferably plated with a suitable conductive material as discussed above. Such a configuration helps support mechanical stress resulting from the mechanical connection between mating interfaces of block 110 and mating interfaces of connectors coupled to them.

The dimensions and configurations of mating interfaces should be planned with efficient electrical transmission in mind, to allow for enough current-carrying mass and contact area. The larger the current needed for a particular implementation, the larger the mating interfaces need to be. This requirement has a positive side effect. Larger amounts of current tend to require larger gauge cables, and having larger pins increases the mechanical integrity needed to oppose the stress created by such large gauge cables.

Systems that may encounter high vibration or stress can employ a suitable support system, such as bracketing of the cables, to support the mechanical coupling of the mating interface. Although all mating interfaces of block 110 are depicted as consisting of a single pin, a single mating interface can employ multiple pins to provide an electrical coupling between the mating interface and that of a removable connector (or battery clamp, as discussed below). Such a configuration increases the mechanical stability while also increasing the current carrying ability of the mating interface.

Preferably, parallel-connected fuses all have the same current rating (within reasonable manufacturing tolerances). A parallel arrangement with one or more fuses having a higher current rating than other fuses could have unpredictable or undesirable current-limiting behavior. For example, if three fuses in a four-fuse arrangement have a current rating of ten Amperes (A) and the fourth fuse has a current rating of 20 A, the fourth fuse is likely to have a lower resistance than the first three fuses. Thus, less than one-fourth of the total current is likely to pass through the first three fuses, making the conditions under which current is interrupted unpredictable.

In some configurations, however, one or more fuses can be omitted from a column of fuses to achieve a desired current rating. In the example above, an overall current rating of 30 A can be achieved by using three fuses of 10 A and leaving an open-circuit connection in the receptacle for the fourth fuse. As a further example, a single conduction path can be configured for the various fused current ratings with the following combinations of 40 A fuses: (1) 40 A, 1 fuse; (2) 80 A, 2 fuses; (3) 120 A, 3 fuses; (4) 160 A, 4 fuses.

To avoid having an open socket and the appearance of an incomplete fuse arrangement, a "zero-amp" fuse can be inserted into the open-circuit receptacle. A "zero-amp" fuse appears to be a regular fuse (except for a "0" marking) but has no electrical connection between its terminals. For high voltage implementations, an insulating material with high breakdown voltage can be used to separate the terminals. In a variation where some conduction paths may be fused and some conduction paths not fused, jumpers can be inserted in fuse receptacles instead of fuses.

Fuses (or jumpers) can be secured in place by any suitable structural arrangement. In some variations, fuses can be secured in their fuse receptacles by friction of their terminals in the fuse receptacles alone. Other variations can include mechanical restraints (e.g., clips, straps, handle-actuated terminal receptacles such as are found in "zero-insertion-force" EPROM sockets, etc.) to restrain fuses, alternatively or in addition to any frictional restraint at the fuse terminals. For example, cover 114 of system 100 can be dimensioned to place downward pressure on fuses in block 110 when cover 114 is fastened to block 110 by tabs 115 and 116.

A fuse according to various aspects of the invention includes any structure suitable for interrupting the flow of power (typically electrical, but non-electrical fuses are certainly possible) when the power flow exceeds a predetermined limit. Suitable types of fuses include those listed in TABLE IV below.

TABLE IV

| Fuse Type | Mode of Operation |
|---|---|
| Temperature actuated link | Fusible link melts when excessive electrical current flows through it. |
| Temperature actuated switch | Mechanical switch interrupts current flow when a temperature-based sensing device detects excessive electrical current. (Circuit breaker.) |
| Electrically activated switch | Semiconductor switch interrupts current flow when a current sensing device detects excessive electrical current. |

Although the exemplary matrix arrangement discussed above with columns of parallel-connected fuses has particular advantages, such an arrangement is not required. Small fuses connected in parallel according to various aspects of the invention can be arranged in numerous configurations including a star with multiple columns of fuses extending radially outwardly from a center point and a linear array of multiple columns sharing a common axis. In variations where the benefits of arranging parallel-connected fuses in one or more columns is not required, such fuses can be arranged in any conventional manner. For example, fuses can connect in parallel in a conventional single-row arrangement wherein current flows into and out of the row of fuses in a direction substantially parallel to the direction of current flow within the fuses.

Figure 18:
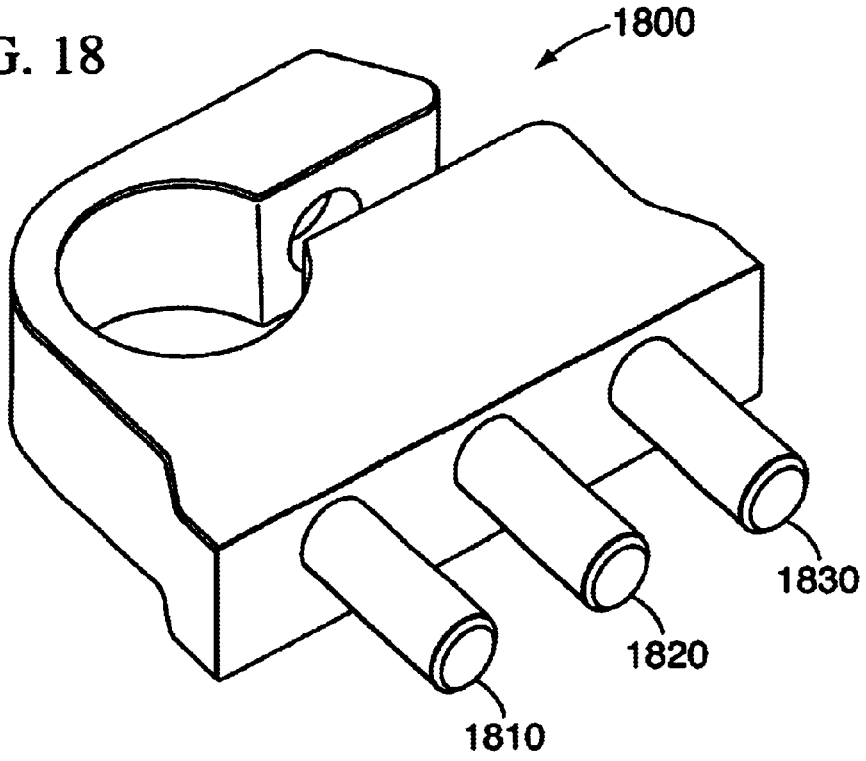
FIGS. 18 and 19 are perspective views of high-current battery clamps according to various aspects of the invention with three and four mating interfaces, respectively.
Figure 19:
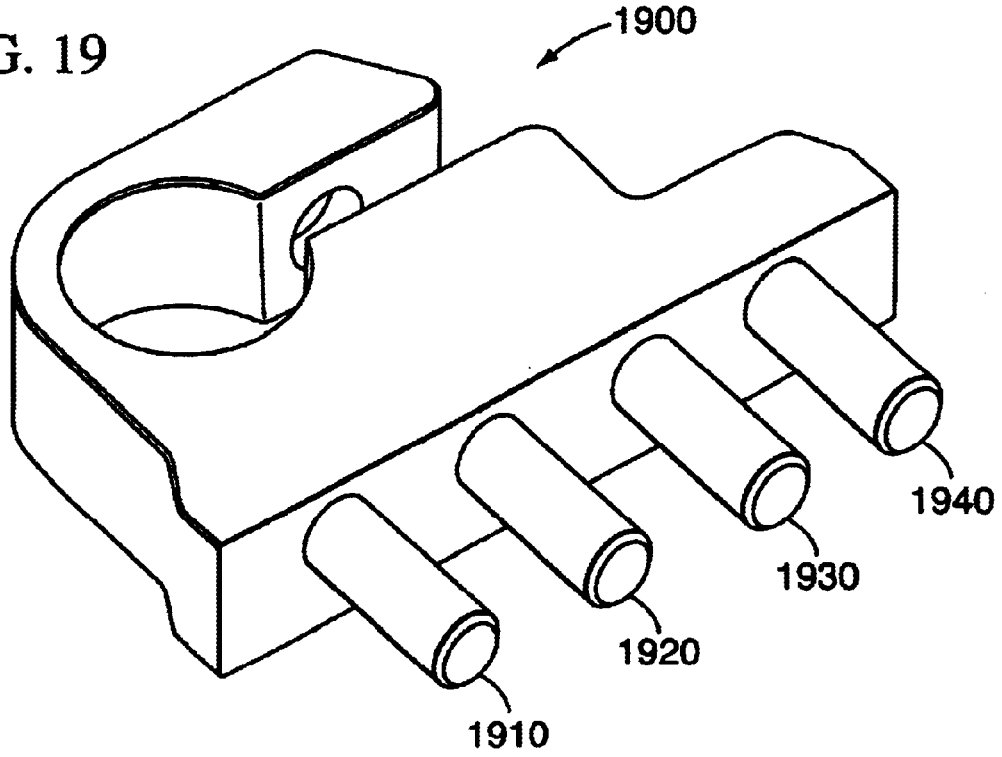

Numerous other variations of a power distribution system and distribution block according to various aspects of the invention can be employed to provide particular advantages in particular implementations. Exemplary variations are discussed below. One or more terminal clamps can be coupled to a distribution block instead of one or more removable connectors. Exemplary terminal clamps 1800 and 1900 may be better understood with reference to FIGS. 18–19. Clamp 1800 of FIG. 18 has three mating interfaces 1810, 1820, and 1830, which are preferably fabricated from the same block of material (e.g., forged or machined aluminum or brass) as the rest of clamp 1800. Clamp 1900 has four mating interfaces 1910, 1920, 1930, and 1940. the preferred fabrication of which is the same as for clamp 1800. As with all electrical connections described herein, mating interfaces 1810–1830 and 1910–1940 are preferably plated as discussed above.

Figure 15:
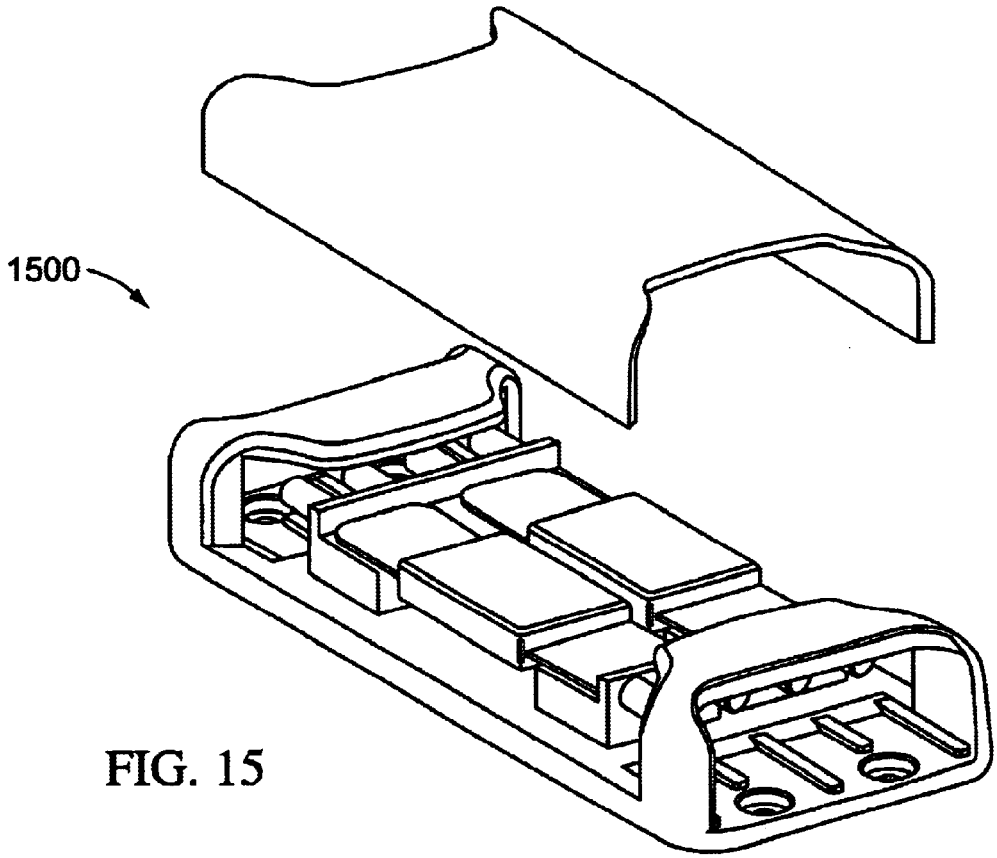
FIG. 15 is an exploded perspective view of a power distribution system according to another variation of the invention having two conduction paths with conventional high-current fuses.
Figure 16:
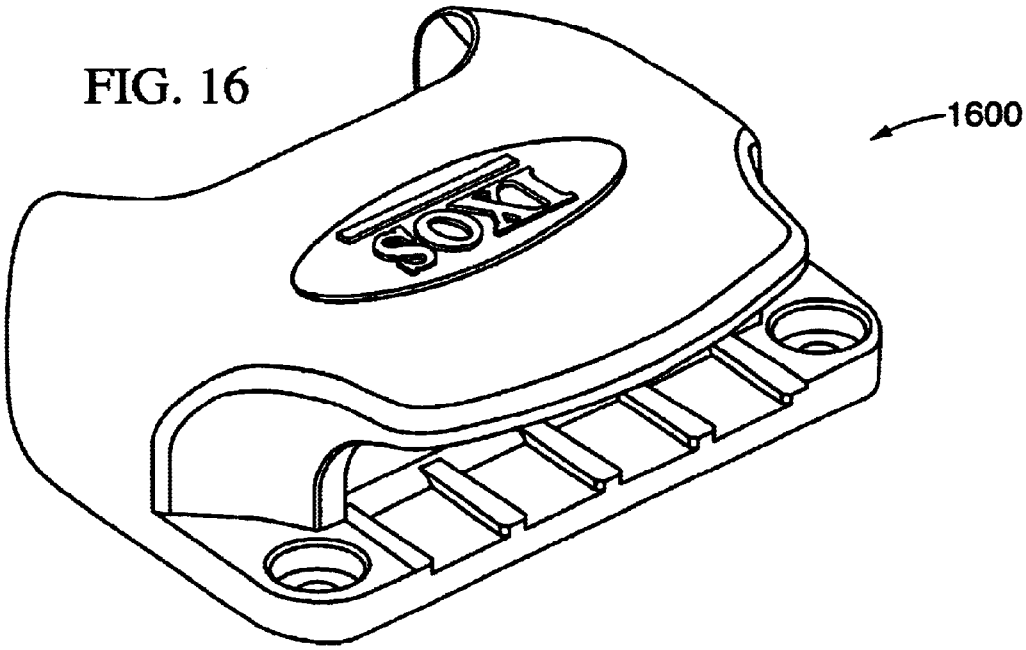
FIG. 16 is a perspective view of a power distribution system according to another variation of the invention having four conduction paths and no fuses.
Figure 17:
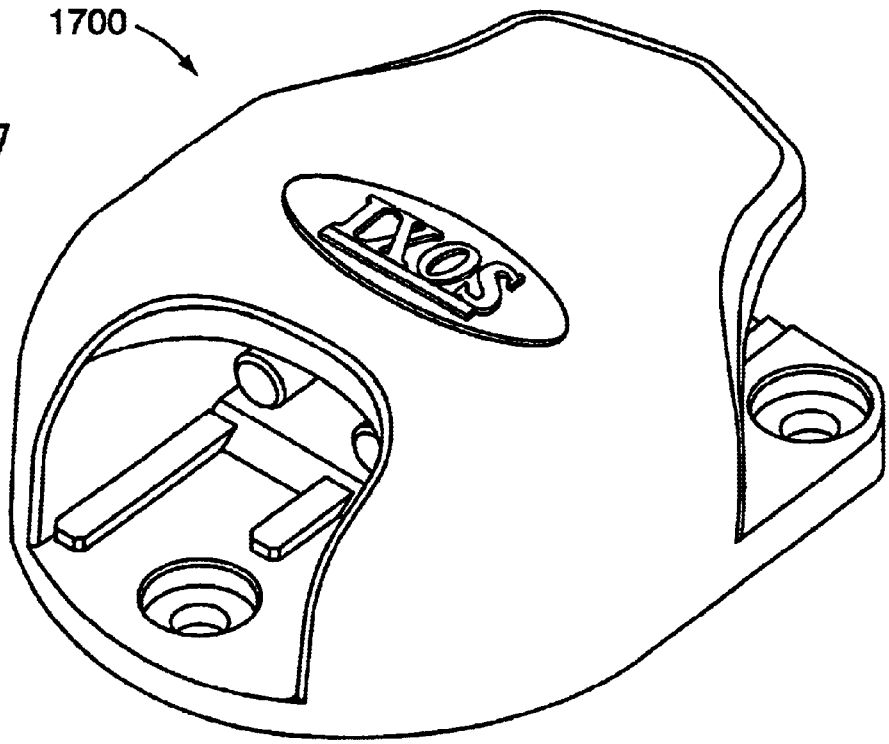
FIG. 17 is a perspective view of a power distribution system according to another variation of the invention having two conduction paths and no fuses.

As may be better understood with reference to FIGS. 15–17, variations in which the benefits of parallel-connected fuses are not required can employ a single fuse (or no fuse) for each conduction path. Distribution block 1500 of FIG. 15 employs a pair of large, conventional fuses, one for each of two parallel (in orientation, not electrical connection) conduction paths. In block 1500, two mating interfaces are provided at each end of each fuse. Thus, connectors coupled to block 1500 need not make the parallel connection between the adjacent mating interfaces of block 1500. Distribution blocks 1600 of FIG. 16 and 1700 of FIG. 17 have four and two conduction paths, respectively, with no fuses at all.

Figure 14:
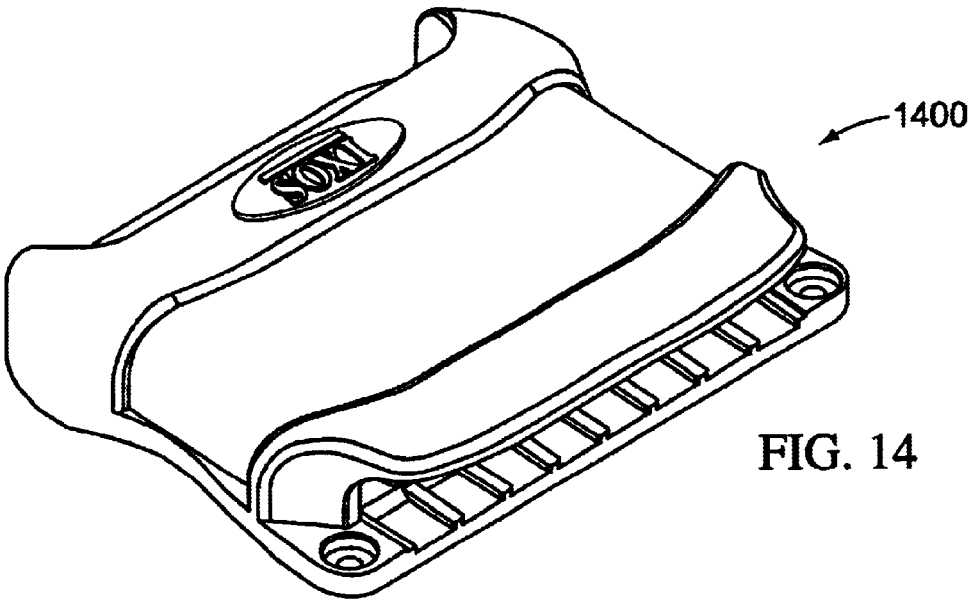
FIG. 14 is a perspective view a power distribution system according to a variation of the invention having eight conduction paths.

A distribution block according to various aspects of the invention need not have any particular number of conduction paths. However, blocks having 2, 4, and 8 conduction paths may be considered particularly desirable. As discussed in detail above, block 110 of exemplary system 100 has four parallel conduction paths. A variant block 1400 with eight conduction paths is illustrated in FIG. 14.

A distribution block according to various aspects of the invention can include circuitry to indicate when one or more fuses has interrupted the flow of power through the block. For example, a light-emitting-diode (LED) can connect across the terminals of a fuse (or fuses in a column of parallel-connected fuses) so that the LED illuminates when the fuse creates an open circuit condition and a consequent voltage drop. In variations where the block has designated outputs, an LED can connect to each output to indicate when power is not being supplied due (presumably) to an open-circuit fuse. More elaborate indicators such as resistance detectors and circuitry associated with electronic fuses can also be employed.

A power distribution system need not be assembled and operational to be useful for, among other things, marketing purposes. For example, display packages 2000 and 2100 of FIGS. 20 and 21 contain components of disassembled power distribution systems 2020 and 2120, respectively. When package 2000 is sealed for display, cover 2010 and backer 2030 encase components of system 2020. (Either cover 2010 or backer 2030, or both, can be made of transparent plastic so that components of system 2020 are clearly visible.) Similarly, when package 2100 is sealed for display, cover 2110 and backer 2130 encase components of system 2120.

Figure 20:
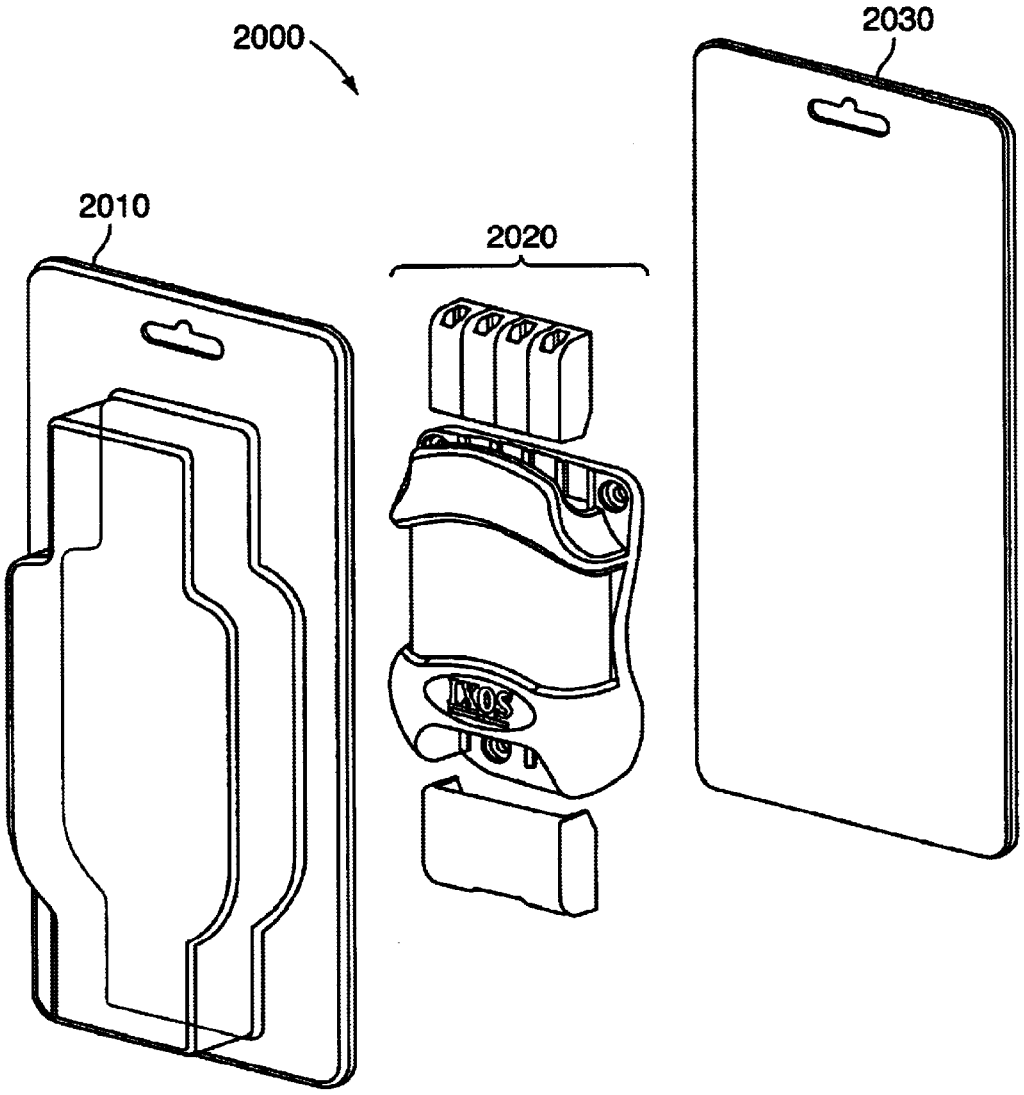
FIG. 20 is an exploded perspective view of a disassembled power distribution system according to various aspects of the invention with extra connectors and packaging material.
Figure 21:
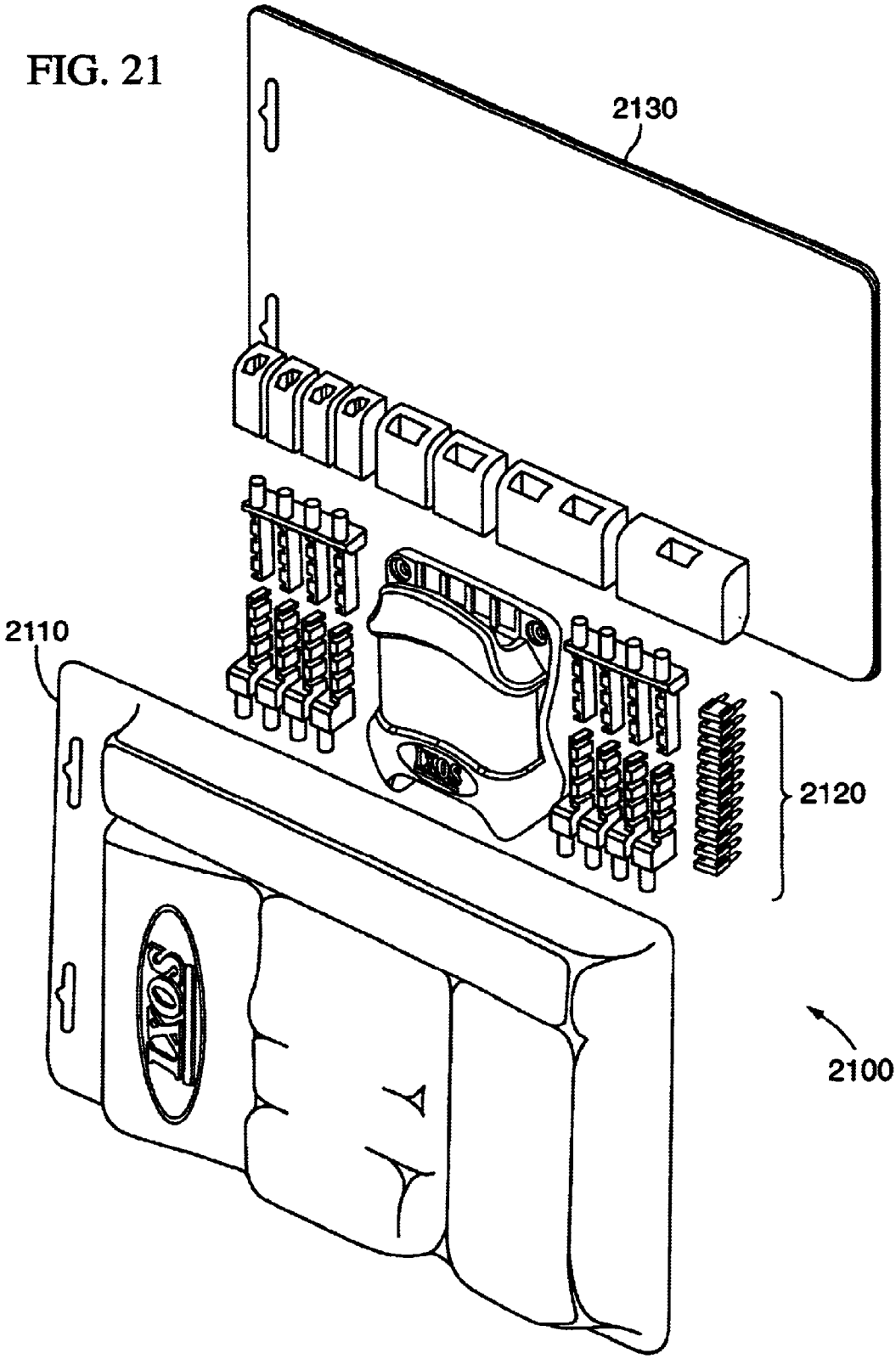
FIG. 21 is an exploded perspective view of another disassembled power distribution system according to various aspects of the invention with extra connectors and packaging material.

As depicted in FIGS. 20 and 21, the components of systems 2020 and 2120 are not electrically coupled; indeed, system 2120 of FIG. 21 includes more connectors than can be simultaneously coupled to the four conduction paths of its distribution block. However, the illustrated configurations of systems 2000 and 2100 permits a prospective buyer to readily view all components of the systems and appreciate the fact that the systems include enough connectors to form many different power distribution configurations.

PUBLIC NOTICE REGARDING THE SCOPE OF THE INVENTION AND CLAIMS

While the invention has been described in terms of preferred embodiments and generally associated methods, the inventor contemplates that alterations and permutations of the preferred embodiments and methods will become apparent to those skilled in the art upon a reading of the specification and a study of the drawings. For example, a distribution block that includes tubing, flow-sensing devices, and connectors with internal "Y-junction" mating interfaces can be employed for distributing (and limiting) a flow of pressurized air from a single compressor to various devices.

Accordingly, neither the above description of preferred exemplary embodiments nor the abstract defines or constrains the invention. Rather, the issued claims variously define the invention. Each variation of the invention is limited only by the recited limitations of its respective claim, and equivalents thereof, without limitation by other terms not present in the claim. For example, claims that do not recite limitations regarding fuses read on devices and methods that include, and exclude, fuses. As another example, claims not reciting limitations regarding the reconfigurable aspects of the invention read on devices and methods that include, and exclude, removable connectors.

In addition, aspects of the invention are particularly pointed out in the claims using terminology that the inventor regards as having its broadest reasonable interpretation; the Ci more specific interpretations of 35 U.S.C. §112 (6) are only intended in those instances where the term "means" is actually recited. The words "comprising," "including," and "having" are intended as open-ended terminology, with the same meaning as if the phrase "at least" were appended after each instance thereof.

What is claimed is:

1. Apparatus for interconnecting a plurality of parallel fuses, the apparatus comprising:

(a) a column of fuse receptacles, each of the receptacles including first and second terminals;

(b) a first electrical conductor coupling together the first terminals of the receptacles and leading from a first end of the column of fuse receptacles; and (c) a second electrical conductor substantially parallel in orientation with the first electrical conductor, the second electrical conductor coupling together the second terminals of the receptacles and leading from a second end, opposite the first end, of the column of fuse receptacles.

2. The apparatus of claim 1 further comprising:

(a) a second column of fuse receptacles that each include third and fourth terminals;

(b) a third electrical conductor coupling together the third terminals of the receptacles and leading from a first end of the second column of fuse receptacles; and (c) a fourth electrical conductor substantially parallel in orientation with the third electrical conductor, the fourth electrical conductor coupling together the fourth teminals of the receptacles and leading from a second end, opposite the first end, of the second column of fuse receptacles.

3. The apparatus of claim 2 further comprising first and second arrays of mating interfaces, wherein:

(a) each mating interface in the first array is coupled to an electrical conductor of a first plurality that includes the first and third electrical conductors;

(b) each mating interface in the second array is coupled to an electrical conductor of a second plurality that includes the second and fourth electrical conductors; and (c) the first and second arrays are disposed at opposite ends of the matrix of fuse receptacles.

4. The apparatus of claim 1 wherein the fuse receptacles are oriented substantially parallel to each other.

5. The apparatus of claim 1 wherein:

(a) the fuse receptacles are formed as recesses in a block of rigid, substantially non-conductive material; and (b) the first and second terminals for each respective fuse receptacle are at opposite ends of a respective recess.

6. The apparatus of claim 1 wherein the fuse receptacles are configured to receive automotive fuses.

7. Apparatus for fusing a plurality of electrical conduction paths, the apparatus comprising:

(a) a matrix of fuse receptacles having a plurality of columns and a plurality of rows, each receptacle having first and second terminals;

(b) a first plurality of electrical conductors coupling together the first terminals of the receptacles in each column; and (c) a second plurality of electrical conductors coupling together the second terminal of the receptacles in each column;

whereby the fuse receptacles in each column are electrically connected in parallel.

8. The apparatus of claim 7 further comprising first and second arrays of mating interfaces, wherein:

(a) each mating interface in the first array is coupled to an electrical conductor of the first plurality of electrical conductors;

(b) each mating interface in the second array is coupled to an electrical conductor of the second plurality of electrical conductors; and (c) the first and second arrays are disposed at opposite ends of the matrix of fuse receptacles.

9. The apparatus of claim 7 wherein the fuse receptacles are oriented substantially parallel to each other.

10. The apparatus of claim 7 wherein:

(a) the fuse receptacles are formed as recesses in a block of rigid, substantially non-conductive material; and (d) the first and second terminals for each respective fuse receptacle are at opposite ends of a respective recess.

11. The apparatus of claim 7 wherein the fuse receptacles are configured to receive automotive fuses.

* * * * *